US005348445A

United States Patent [19]

Jwd

[11] Patent Number: 5,348,445

[45] Date of Patent: Sep. 20, 1994

[54] FAN BLADE

[75] Inventor: Chin-Tsaw Jwd, Fengyuan City, Taiwan

[73] Assignee: Cheng-Chi Hung, Fengyuan City, Taiwan

[21] Appl. No.: 162,946

[22] Filed: Dec. 8, 1993

[51] Int. Cl.[5] ..... F04D 29/38

[52] U.S. Cl. ..... 416/229 R; 416/236 R

[58] Field of Search ..... 416/5, 229 R, 235, 236 R, 416/236 A

[56] References Cited

U.S. PATENT DOCUMENTS

| | | | |
|---|---|---|---|
| D. 110,876 | 8/1938 | Preston | 416/236 R |
| 1,806,539 | 5/1931 | Cram | 416/229 R |
| 2,912,159 | 11/1959 | Ganger et al. | 416/235 |
| 3,033,049 | 5/1962 | Morrow | 416/5 |
| 4,653,985 | 3/1987 | Rotherham | 416/229 R |
| 5,244,349 | 9/1993 | Wang | 416/5 |

FOREIGN PATENT DOCUMENTS

| | | | |
|---|---|---|---|
| 185997 | 10/1983 | Japan | 416/236 A |

*Primary Examiner*—Edward K. Look
*Assistant Examiner*—James A. Larson
*Attorney, Agent, or Firm*—Nath, Amberly & Assoc.

[57] ABSTRACT

A fan blade for a ceiling fan is formed as an elongated laminated plate body which includes several layers of thin wooden plates that are bonded together. The laminated plate body has a top face which is formed with projecting strips and a bottom face which is formed with recessed strips that correspond to the projecting strips.

3 Claims, 3 Drawing Sheets

FAN BLADE

BACKGROUND OF THE INVENTION

1. Field of the Invention

The invention relates to a fan blade for a ceiling fan, more particularly to a fan blade which is lighter, more durable and which can generate a stronger air current than conventional fan blades.

2. Description of the Related Art

Conventional fan blades for ceiling fans are usually made of plastic or wood. Conventional plastic fan blades generally have a thickness of at least 6 mm and are relatively heavy. Thus, when a motor of the ceiling fan drives rotatably the conventional plastic fan blades, the load which is borne thereby is relatively heavy and can cause the motor to overheat. If the thickness of the conventional plastic fan blade is reduced, deformation of the same is likely to occur because the strength of the same is reduced. A deformed fan blade would be unable to induce air currents efficiently. Wooden fan blades also require a minimum thickness in order to provide sufficient strength thereto. Thus, the motor of the ceiling fan also bears a relatively heavy load when conventional wooden fan blades are in use. In addition, conventional fan blades have flat top and bottom faces, thereby preventing the fan blades from inducing strong air currents.

SUMMARY OF THE INVENTION

Therefore, the objective of the present invention is to provide a fan blade which is adapted for use in a ceiling fan and which is lighter, more durable and which can generate a stronger air current than conventional fan blades.

Accordingly, the fan blade of the present invention is adapted for use in a ceiling fan and comprises an elongated laminated plate body which includes several layers of thin wooden plates that are bonded together. The laminated plate body has a top face which is formed with projecting strips and a bottom face which is formed with recessed strips that correspond to the projecting strips.

In one aspect of the present invention, the projecting strips extend from a rear end to a front end of the laminated plate body and include a pair of spaced elongated projections that divide the top face of the laminated plate body into an intermediate region and side regions disposed on two sides of the intermediate region, and a zigzag projection that is formed in each of the side regions between one of two opposite longitudinal edges of the laminated plate body and one of the elongated projections.

The fan blade of the present invention is lighter and more durable than the prior art because it is formed as a laminate. Furthermore, the presence of the projecting and recessed strips can also enhance the air-current inducing ability of the fan blade.

BRIEF DESCRIPTION OF THE DRAWINGS

Other features and advantages of the present invention will become apparent in the following detailed description of the preferred embodiment, with reference to the accompanying drawings, of which.

DETAILED DESCRIPTION OF THE PREFERRED EMBODIMENT

Figure 1:
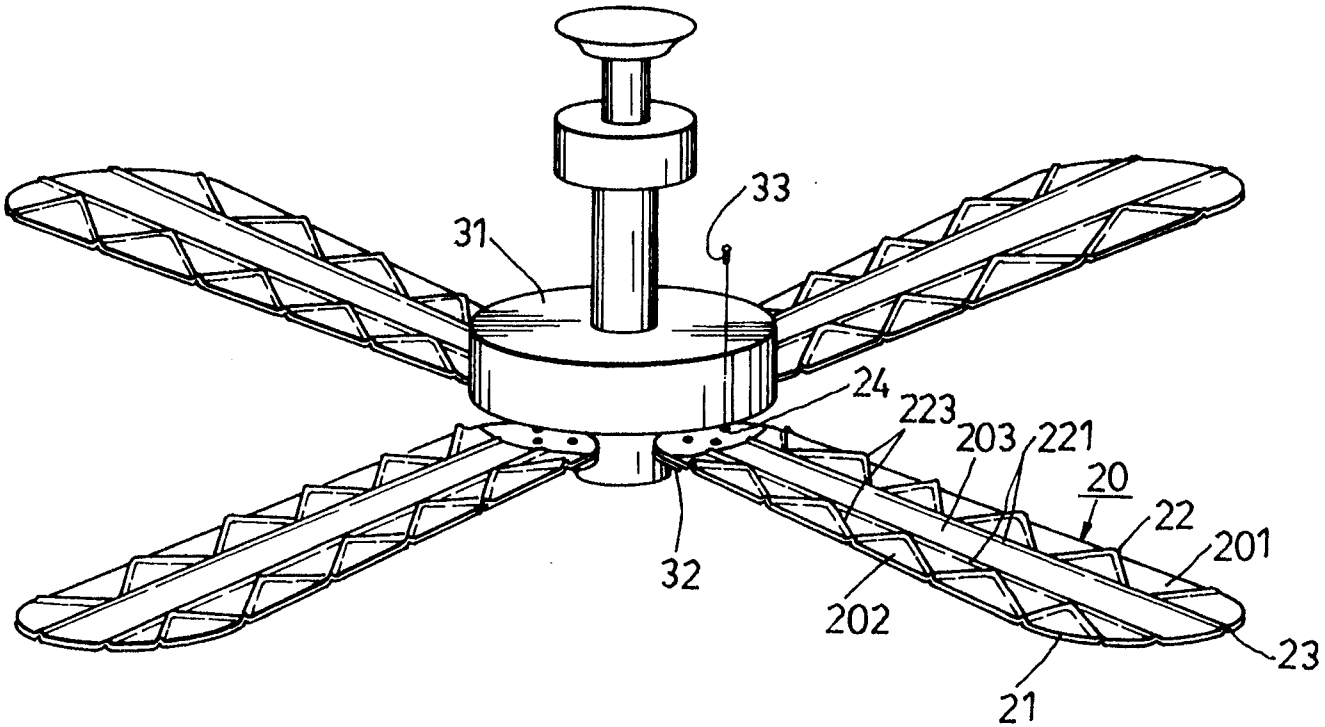
FIG. 1 is an illustration of a ceiling fan which incorporates four of the fan blades of the present invention.
Figure 2:
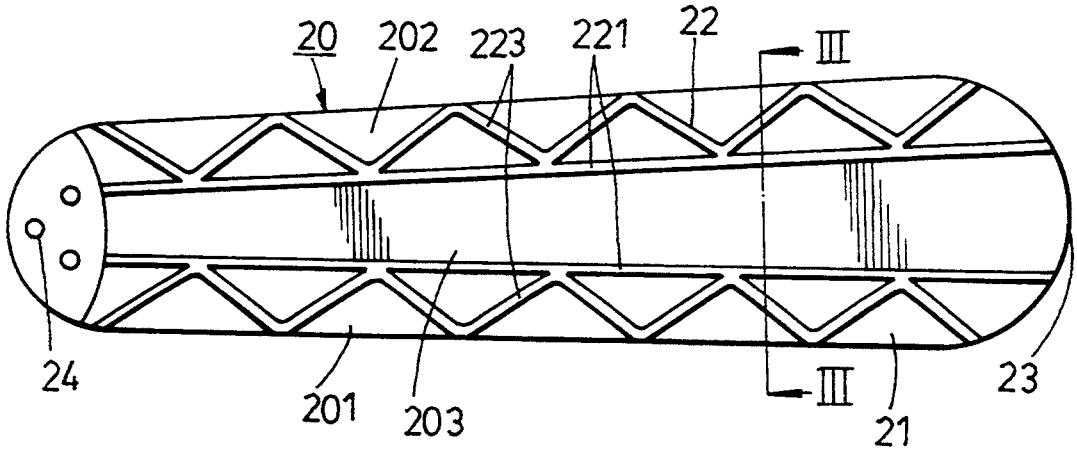
FIG. 2 is a top view of the preferred embodiment of a fan blade according to the present invention.
Figure 3:
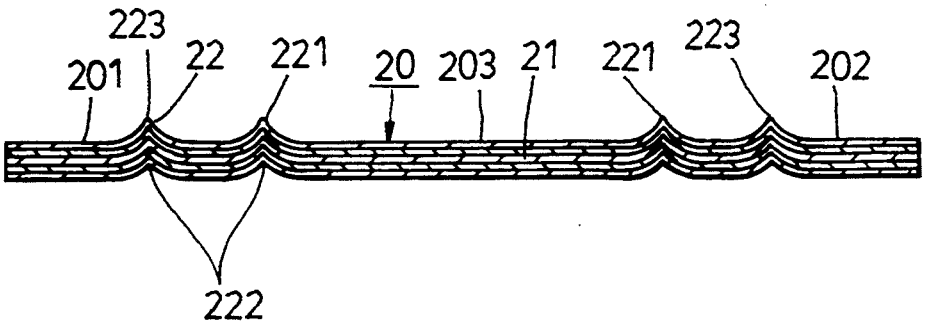
FIG. 3 is a sectional view of the preferred embodiment taken along line III—III in FIG. 2.

Referring to FIG. 1 to 3, four fan blades 20 according to the present invention are mounted fixedly on a motor 31 of a ceiling fan. Each fan blade 20 comprises several layers of thin wooden plates 21 that are bonded together with the use of adhesives and that are provided in a mold assembly (not shown) so as to undergo a heat-press operation in order to form an elongated laminated plate body with a predetermined thickness, such as about 3 mm. In this embodiment, the fan blade 20 comprises five layers of thin wooden plates 21. The thin wooden plates 21 may be made from waste wood materials to reduce the material cost of the fan blade 20. The upper and lower molds of the mold assembly are patterned so as to form projecting strips 22 on the top face of the fan blade 20 and recessed strips 222 which correspond to the projecting strips 22 on the bottom face of the same. The projecting strips 22 extend from a rear end to a curved front end 23 of the fan blade 20 and include a pair of spaced elongated projections 221 that divide the top face of the fan blade 20 into an intermediate region 203 and side regions 201, 202 disposed on two sides of the intermediate region 203, and a zigzag projection 223 that is formed in each of the side regions 201, 202 between one of two opposite longitudinal edges of the fan blade 20 and one of the elongated projections 221. The width of the fan blade 20 increases gradually from the rear end to the curved front end 23 of the same. The rear end of the fan blade 20 is formed with a plurality of mounting holes 24. Screws 33 extend into the mounting holes 24 to mount the fan blade 20 fixedly on a respective mounting plate 32 on the motor 31 of the ceiling fan.

The provision of the projecting strips 22 and the recessed strips 222 on the fan blade 20 of the present invention serves to strengthen the fan blade 20 while permitting a thickness which is much less than that of the conventional fan blades. Therefore, the fan blade 20 does not deform when the motor 31 of the ceiling fan drives rotatably the same. Furthermore, the load which is borne by the motor 31 is lighter than that when conventional fan blades are in use, thereby minimizing the risk of overheating of the motor 31.

Figure 4:
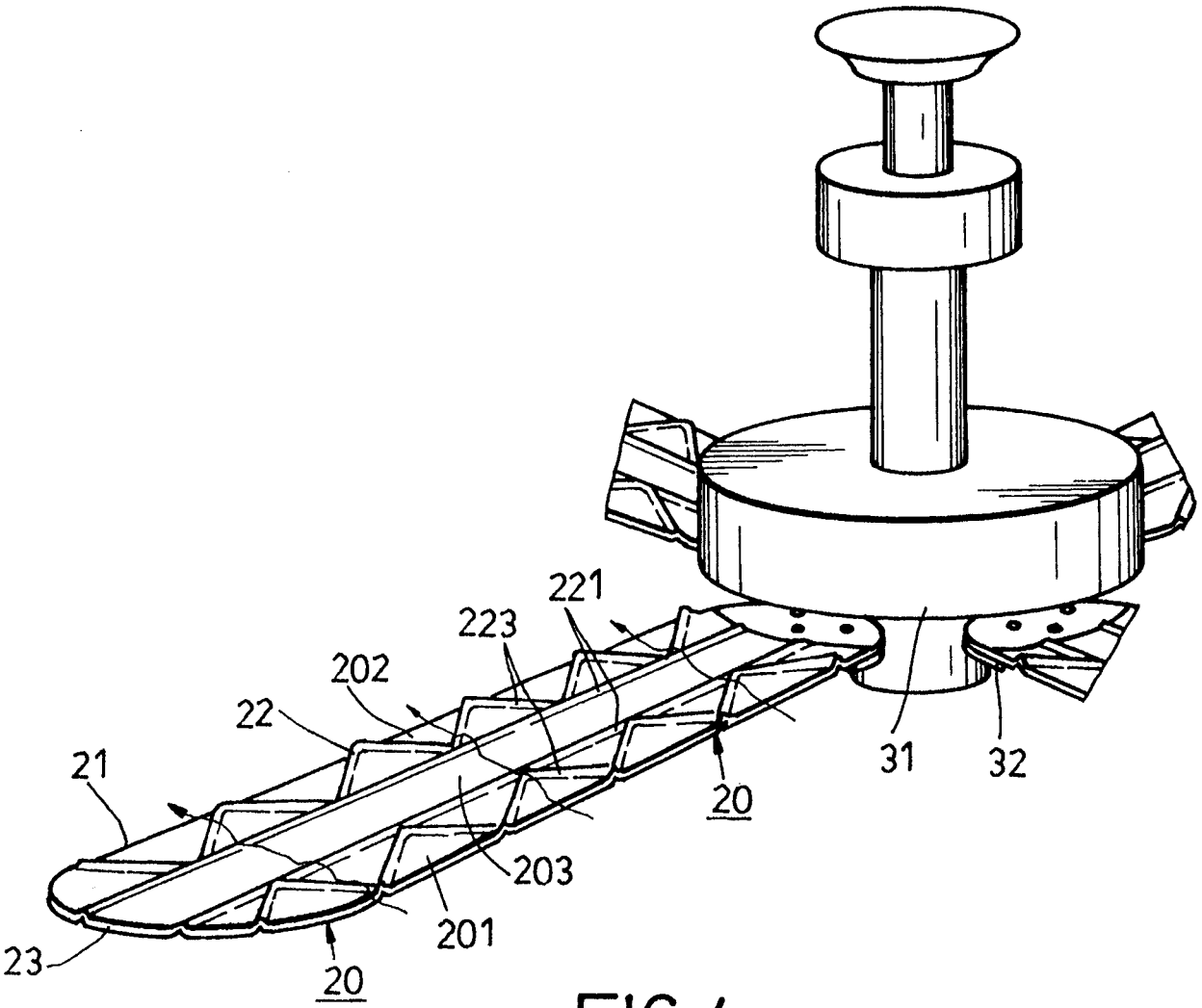
FIG. 4 is a fragmentary perspective view of the ceiling fan shown in FIG. 1 to illustrate the flow of air currents which are induced by a fan blade of the present invention.

The projecting strips 22 and the recessed strips 222 not only strengthen the fan blade 20 but can also enhance the aesthetic appeal and the air-current inducing ability of the latter. Referring to FIG. 4, when the fan blade 20 is rotated, air at the top face of the fan blade 20 impacts the projecting strips 22, thereby lengthening the route of the air current that is generated so as to result in the generation of a stronger air current.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A fan blade for a ceiling fan, comprising an elongated laminated plate body which includes several layers of thin wooden plates that are bonded together, and which has a top face that is formed with projecting strips and a bottom face that is formed with recessed strips corresponding to said projecting strips, wherein said laminated plate body has a rear end, a front end and opposite longitudinal edges, said projecting strips extending from said rear end to said front end of said laminated plate body and including a pair of spaced elongated projections that divide said top face of said laminated plate body into an intermediate region and two side regions disposed on two sides of said intermediate region, and a zigzag projection that is formed in each of said side regions between one of said longitudinal edges of said laminated plate body and one of said elongated projections.

2. The fan blade as claimed in claim 1, wherein said front end is curved, and said laminated plate body has a width which increases gradually from said rear end to said front end.

3. The fan blade as claimed in claim 1, wherein said laminated plate body has a thickness of about 3 mm.

* * * * *